US006659322B1

(12) United States Patent
De Man et al.

(10) Patent No.: US 6,659,322 B1
(45) Date of Patent: Dec. 9, 2003

(54) TAPE DISPENSER

(75) Inventors: Eelco H. De Man, Helmond (NL); Erwin Boes, Nijmegen (NL)

(73) Assignee: Kel Development B.V., Vlijmen (NL)

( * ) Notice: Subject to any disclaimer, the term of this patent is extended or adjusted under 35 U.S.C. 154(b) by 0 days.

(21) Appl. No.: 09/980,501

(22) PCT Filed: May 24, 2000

(86) PCT No.: PCT/IB00/00693

§ 371 (c)(1),
(2), (4) Date: Nov. 29, 2001

(87) PCT Pub. No.: WO00/73187

PCT Pub. Date: Dec. 7, 2000

(30) Foreign Application Priority Data

May 31, 1999 (CH) ..... 1017/99

(51) Int. Cl.[7] ..... B26F 3/00; B65H 35/00

(52) U.S. Cl. ..... 225/93; 225/26; 225/51; 225/53; 225/72; 225/12; 225/74

(58) Field of Search ..... 83/660, 331; 225/12, 225/25, 51, 52, 53, 54, 72, 73, 74, 82, 94, 96, 26, 93; 156/540, 574, 577; 242/598.3, 601

(56) References Cited

U.S. PATENT DOCUMENTS 2,324,204 A * 7/1943 Fischer ..... 156/527
2,590,549 A * 3/1952 Krueger et al. ..... 225/22
2,621,737 A * 12/1952 Ledig ..... 225/11
3,125,263 A * 3/1964 Harbour ..... 156/523
5,073,228 A * 12/1991 Lin ..... 156/523
5,381,942 A * 1/1995 Lin ..... 225/56
5,478,000 A * 12/1995 Jensen ..... 225/93
5,954,257 A * 9/1999 Panneri et al. ..... 225/39
6,170,726 B1 * 1/2001 Jensen ..... 225/12

FOREIGN PATENT DOCUMENTS

EP 0011262 * 11/1979
EP 0236709 * 1/1987
WO 95/32909 * 12/1995

* cited by examiner

*Primary Examiner*—Boyer D. Ashley
(74) *Attorney, Agent, or Firm*—Ann W. Speckman; Janet Sleath

(57) ABSTRACT

The invention relates to a tape dispenser for producing lengths of tape. The tape dispenser comprises a rotatable roller on which the tape is wound up and a rotatable take-off roller across which the tape to be taken off is guided. The take-off roller has at least one perforation element that is directed against the surface of support of the tape and that is used to perforate the tape. The dispenser is further provided with latch elements that block the take-off roller if the tape has covered a certain distance once it has been perforated. The latch elements release the take-off roller once the perforated section at the tape's end is separated from the tape.

10 Claims, 3 Drawing Sheets

TAPE DISPENSER

CROSS-REFERENCE TO RELATED APPLICATION

This application is a national phase filing of PCT International Application No. PCT/IB00/00693, filed May 24, 2000, which claims priority to Swiss Patent Application No. 1017/99, filed May 31, 1999.

FIELD OF THE INVENTION

The present invention relates to a tape dispenser.

BACKGROUND OF THE INVENTION

In many applications in daily life tape strips of a given length are frequently required—strips of adhesive tape for packets or similar items. Simple devices for preparing such tape strips are known—so-called tape dispensers—in which the tape is unrolled from a roll and is guided over a cutting element. As soon as the free end of the tape has reached the desired length, it is cut off by the cutting element. The user determines the length of the tape strip to be cut using such devices by unrolling the desired length of tape and then cutting it. For cutting, the tape end is guided across the cutting element in such a manner that the cutting device can exert its tape cutting action. Such known devices are not effective for generating strips of a given length. Furthermore, handling such devices is complicated, especially for precisely cutting, and thus is awkward for prolonged use.

It thus is the objective of the present invention to create a simple tape dispenser of the type mentioned initially, which is easily operated, and does not require special user manipulation.

SUMMARY OF THE INVENTION

The inventive tape dispenser is of very simple design and permits fast and simple generation of tape strips of given length. The tape strips are generated in a continuous process that does not require any particular manual movements. This ensures high productivity without tiring the user.

Further advantages of the present invention can be seen from the following description, in which various design examples according to the present invention are explained in more detail with reference to the drawings.

BRIEF DESCRIPTION OF THE DRAWINGS

Identical elements shown in the figures are designated by the same reference signs, and first explanations given apply to all figures unless stated otherwise.

DETAILED DESCRIPTION OF THE INVENTION

Figure 1:
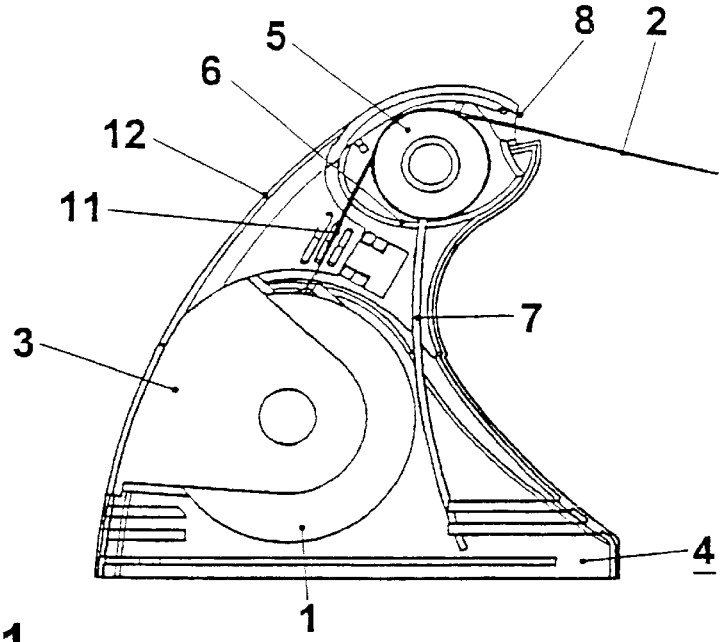
FIG. 1 shows a side view of a tape dispenser of the present invention.
Figure 2:
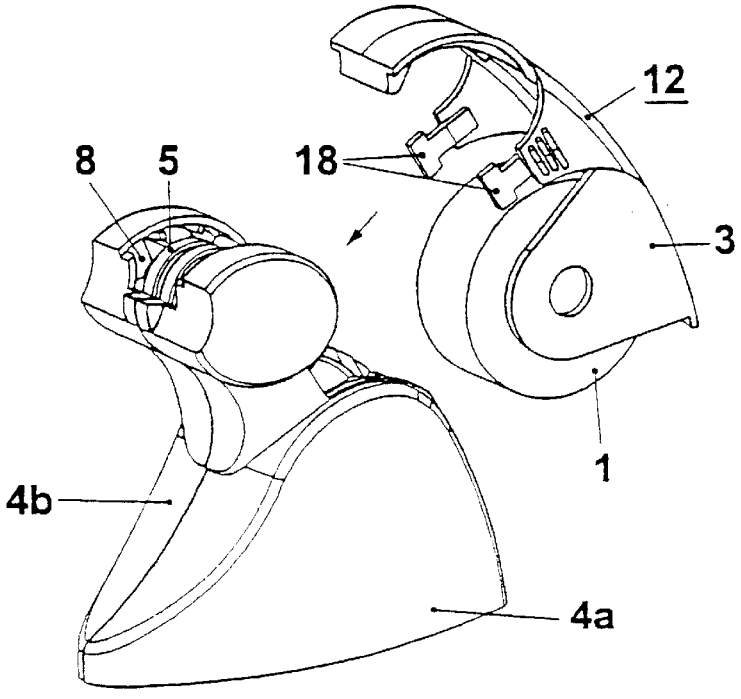
FIG. 2 illustrates the main parts of a complete tape dispenser of the present invention.

In FIGS. 1 and 2 the main parts of the inventive tape dispenser are shown, with a side view of the opened tape dispenser being shown in FIG. 1. Its main parts are a base housing 4 and a housing extension 12 that can be attached to the base housing 4. The connection between base housing 4 and housing extension 12 is effected by snap-on elements 18. Base housing 4 consists of two separable housing halves 4*a*, 4*b*, which can be joined by fitting them together (compare to FIG. 2). In FIG. 1 one half housing is omitted in order to show the interior of the tape dispenser. On housing extension 12 a support member 3 is provided on which a roll 1 with wound-up tape 2 is rotatably mounted. On base housing 4 a rotatable take-off roller 5 is provided, over which tape 2 released from roll 1 is guided. The free end of tape 2 emerges via an opening 8 from base housing 4. Take-off roller 5 comprises a perforating element 6 directed to the underside of tape 2, i.e. to the tape surface lying on take-off roller 5. Perforating element 6 is formed by at least one knife of triangular shape, one point of which protrudes from take-off roller 5. A plurality of such knife elements can be provided arranged side by side. In base housing 4 a latch element 7 is provided—e.g. a spring rod clamped at one of its ends—which, in a manner described below, engages take-off roller 5 which it blocks in a predetermined position and releases again. Well-known tape guides are provided in the interior of the tape dispenser, if required, in order to guide the tape up to the outflow. For replacing an empty roll 1 by a new one, housing extension 12 is detached from base housing 4 and is provided with a new roll. Alternatively, the whole housing extension 12 including roll 1 can be replaced (see FIG. 2).

Figure 3:
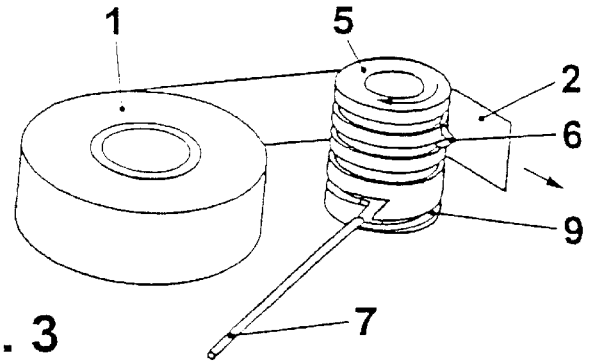
FIG. 3 illustrates the starting position of the free end of the tape.

With reference to FIGS. 3 to 6, the function of the inventive tape dispenser is described in more detail, with only the elements which are required for better understanding being shown. In FIG. 3 the starting position is shown in which the free end of tape 2 exceeds take-off roller 5 after a preceding tape strip has been cut off. If a further strip of tape is to be generated, the user pulls the free end of tape 2 from the housing. In this process take-off roller 5 rotates in the direction of the arrow and perforating element 6 advances with it in the same direction. The free end of spring rod 7 engages a groove 9 extending in take-off roller 5 and, during the rotational movement of the take-off roller 5, is guided therein. The groove 9 extends spirally on the surface of take-off roller 5 from the outer side towards the inner side. In this manner spring rod 7 is pre-tensioned as tape 2 is unwound.

Figure 4:
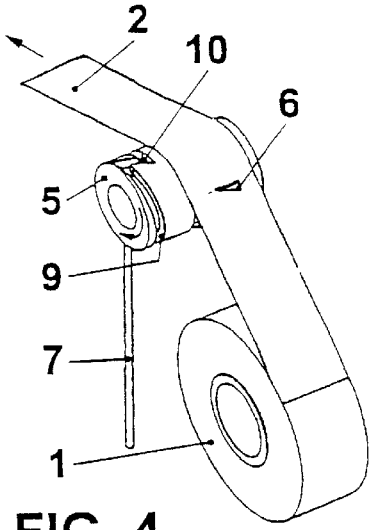
FIG. 4 illustrates rotation of the take-off roller during removal of a strip of tape.
Figure 5:
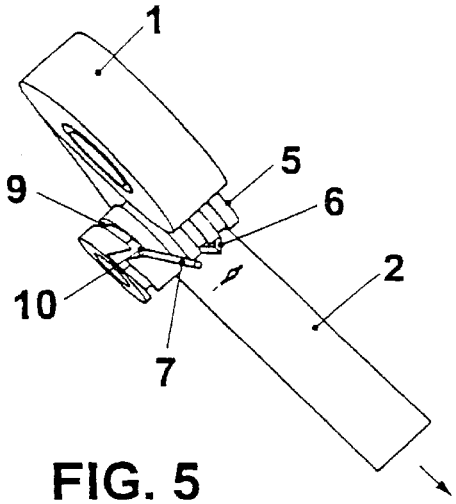
FIG. 5 illustrates a stop position of the take-off roller during removal of a strip of tape.
Figure 6:
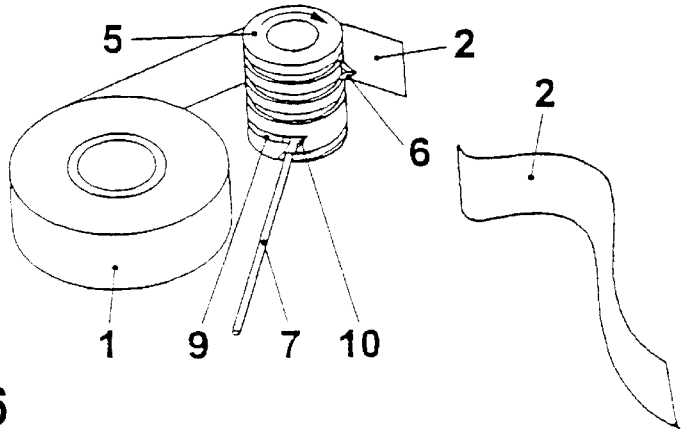
FIG. 6 illustrates removal of a strip of tape and repositioning of the spring rod.

During the rotational movement of take-off roller 5, the perforating element 6 reaches a position in which it first touches tape 2 and then penetrates it (see FIG. 4). As tape 2 moves on, take-off roller 5 keeps rotating until it is blocked by spring rod 7, which moves along groove 9 and then rests against a stop 10 (FIG. 5). If tape 2 is now pulled on in the direction of the arrow, the free end of tape 2 is severed at the point where it had been partially penetrated by perforating element 6. The torque exerted onto take-off roller 5 by the tensile force acting on tape 2 is then suddenly released. Spring rod 7, owing to its pre-tension, then moves without delay from its position blocking the rotation of take-off roller 5 to a position within groove 9 in which the rotational movement is released. In this zone groove 9 is preferably laid out in a z shape. Spring rod 7 moves back to its rest position with a low pre-tension. Thus the starting position according to FIG: 1 is reached again, and a subsequent tape strip can be generated when the user again pulls- tape 2 at its free end from housing 4. The length of the tape strip to be generated is determined by the outer circumference of take-off roller 5.

Figure 7:
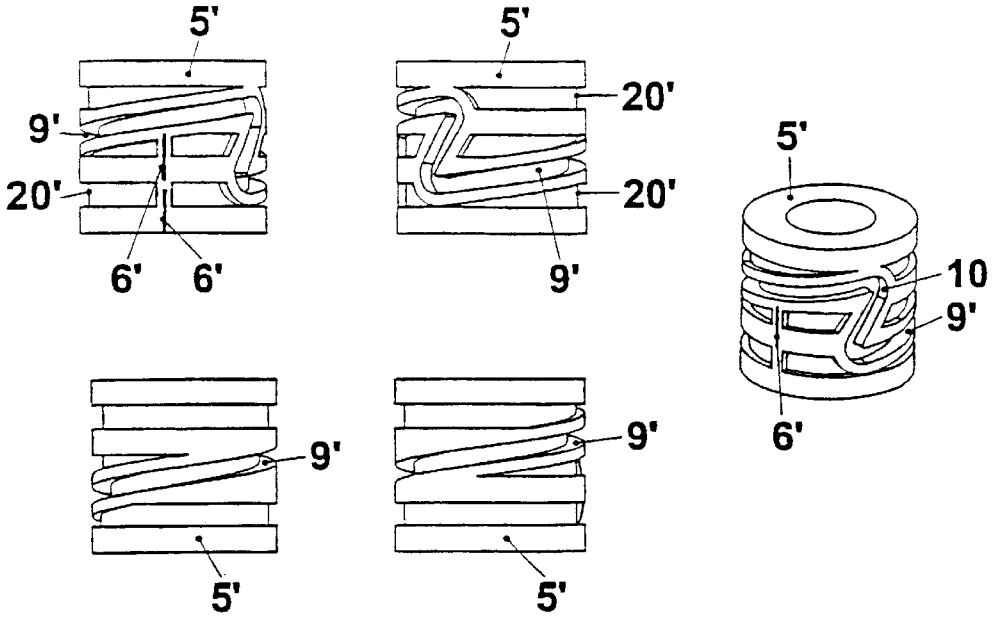
FIG. 7 illustrates a variant of the take-off roller.

In FIG. 7 a variant of take-off roller 5 is shown, wherein groove 9' is arranged approximately in the center of take-off roller 5 and two adjacent perforation elements 6' are provided laterally thereof. In particular, the z-shaped layout of groove 9' is provided with larger rounded portions in the zone of stop 10'. Groove 9' shown here functions exactly in the same manner as the one on take-off roller. 5 described with reference to FIGS. 3 to 6, i.e. the friction surfaces in the z-shaped zone of groove 9' prevent spring rod 7 from jumping back to its starting position as long as adhesive tape 2 is not yet severed. The further recesses 20' provided on take-off roller 5' ensure that adhesive tape 2 is not clinging to its surface too intensely.

Figure 8A:
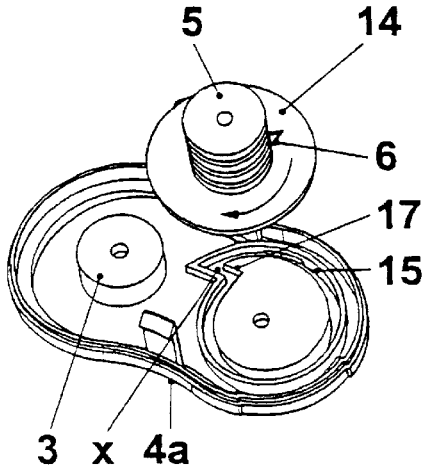
FIG. 8 shows a second design of the tape dispenser.
Figure 8B:
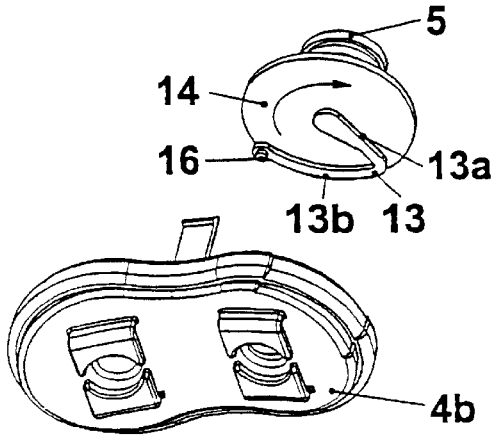

FIG. 8 shows a tape dispenser with an alternative design of the latch element. In FIG. 8*a* the interior of a housing half 4*a* is shown with a support member 3 for taking up the tape roll. Take-off roller 5 is provided with a support disc 14 arranged laterally on which a tension spring 13 is arranged which functions as a latch element (see FIG. 8*b*). Tension spring 13 consists of a part 13*a* rigidly connected to support disc 14 and of a spring arm 13*b* with a spring head 16. A spirally extending groove 15 with a stop 17 is arranged inside housing 4. Support disc 14 is arranged in such a manner that spring head 16 engages groove 15. In the starting position for generating a strip of tape, spring head 16 is located at the point designated "x" in groove 15. As take-off roller 5 rotates in the direction of the arrow, spring head 16 moves from its starting position to, stop 17, exerting a continually increasing pressure force onto spring arm 13*b* whereby spring arm 13*b* is pre-tensioned. The latch element shown here is made as a unit from a suitable two component synthetic material using an injection moulding method.

The mechanism for generating a strip of tape in principle is the same as in the tape dispenser according to FIGS. 1 to 6. As spring head 16 moves on its way to stop 17, the tape passing over take-off roller 5 is penetrated by perforating element 6. Thereupon spring head 16 meets stop 17 and take-off roller 5 is blocked. As the perforated tape is severed, spring head 16 jumps back to its starting position "x" without delay. The pre-tension of spring arm 13*b* is released and the tape dispenser is ready for generating a further strip of tape.

What is claimed is:

1. An adhesive tape dispenser for producing lengths of adhesive tape comprising:

(a) a rotatably supported roll on which adhesive tape is wound up;

(b) a rotatably supported take-off roller across part of which the adhesive tape to be taken off is guided, the take-off roller being provided with at least one perforating element that is directed against a supporting surface of the adhesive tape; and (c) a pre-tensioned latch element which locks the take-off roller after the adhesive tape has been perforated and has moved over a predetermined path length, and which releases the take-off roller once a perforated section at an end of the adhesive tape is separated from the adhesive tape, wherein the latch element comprises a spring rod which engages a groove extending spirally as a closed loop with a stop on the take-off roller.

2. An adhesive tape dispenser according to claim 1, wherein groove-type recesses are provided on the surface of the take-off roller to reduce adherence of the adhesive tape.

3. An adhesive tape dispenser according to claim 1, wherein the stop is essentially a z-shape.

4. An adhesive tape dispenser according to claim 1, further comprising a base housing in which the take-off roller is located and a housing extension in which an adhesive tape roll is located.

5. An adhesive tape dispenser according to claim 4, wherein the housing extension is attachable to the base housing.

6. An adhesive tape dispenser for producing lengths of adhesive tape comprising:

(a) a rotatably supported roll on which adhesive tape is wound up;

(b) a rotatably supported take-off roller across part of which the adhesive tape to be taken off is guided, the take-off roller being provided with at least one perforating element that is directed against a supporting surface of the adhesive tape; and (c) a pre-tensioned latch element which locks the take-off roller after the adhesive tape has been perforated and has moved over a predetermined path length, and which releases the take-off roller once a perforated section at an end of the adhesive tape is separated from the adhesive tape, wherein the latch element comprises a tension spring provided lateral to the take-off roller, the tension spring comprising a spring arm with a spring head that is guided in a groove extending spirally as a closed loop with a stop.

7. An adhesive tape dispenser according to claim 6, wherein groove-type recesses are provided on the surface of the take-off roller in order to reduce adherence of the adhesive tape.

8. An adhesive tape dispenser according to claim 6, wherein the stop is essentially a z-shape.

9. An adhesive tape dispenser according to claim 6, further comprising: a base housing in which the take-off roller is located and a housing extension in which an adhesive tape roll is located.

10. An adhesive tape dispenser according to claim 9, wherein the housing extension is attachable to the base housing.

* * * * *